US011806292B2

(12) United States Patent
Paul et al.

(10) Patent No.: US 11,806,292 B2
(45) Date of Patent: Nov. 7, 2023

(54) TECHNIQUES FOR CONTROLLING ACTUATORS OF A PATIENT SUPPORT APPARATUS

(71) Applicant: Stryker Corporation, Kalamazoo, MI (US)

(72) Inventors: Anish Paul, Kalamazoo, MI (US); Krishna Bhimavarapu, Kalamazoo, MI (US); Madhu Sandeep Thota, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 17/839,987

(22) Filed: Jun. 14, 2022

(65) Prior Publication Data

US 2022/0304876 A1 Sep. 29, 2022

Related U.S. Application Data

(63) Continuation of application No. 17/166,126, filed on Feb. 3, 2021, now Pat. No. 11,389,353, which is a (Continued)

(51) Int. Cl.
*A61G 7/018* (2006.01)
*A61G 7/015* (2006.01)
(Continued)

(52) U.S. Cl.
CPC ..... *A61G 7/018* (2013.01); *A61G 7/012* (2013.01); *A61G 7/015* (2013.01); *A61G 7/0507* (2013.01);
(Continued)

(58) Field of Classification Search
CPC . A61G 7/00; A61G 7/02; A61G 7/018; A61G 7/012; A61G 7/015; A61G 7/0507;
(Continued)

(56) References Cited

U.S. PATENT DOCUMENTS 5,715,548 A 2/1998 Weismiller et al.
5,771,511 A 6/1998 Kummer et al.
(Continued)

OTHER PUBLICATIONS

CHG Hospital Beds, "The Spirit Select Bed Ref 5700 User Manual", 2016, 172 pages.

*Primary Examiner* — Fredrick C Conley
(74) *Attorney, Agent, or Firm* — Howard & Howard Attorneys PLLC

(57) ABSTRACT

Systems, methods, and techniques for operating a patient support apparatus are disclosed. The patient support apparatus includes moveable components and actuators to actuate the components. A user interface receives a user input to manipulate the actuatable components and produces an input signal in response to receiving the user input. A behavior controller receives the input signal from the user interface, generates a motion command signal based on the input signal, and transmits the motion command signal. A motion controller receives the motion command signal from the behavior controller and receives feedback signals from one or more of the actuators. The feedback signals are provided solely to the motion controller. The motion controller controls one or more of the actuators to actuate one or more of the actuatable components based on the motion command signal and the feedback signals.

20 Claims, 9 Drawing Sheets

Related U.S. Application Data continuation of application No. 16/186,857, filed on Nov. 12, 2018, now Pat. No. 10,945,902.

(60) Provisional application No. 62/585,226, filed on Nov. 13, 2017.

(51) Int. Cl.
*A61G 7/08* (2006.01)
*A61G 7/05* (2006.01)
*A61G 7/012* (2006.01)

(52) U.S. Cl.
CPC ..... *A61G 7/0524* (2016.11); *A61G 7/08* (2013.01); *A61G 2203/16* (2013.01); *A61G 2203/726* (2013.01)

(58) Field of Classification Search
CPC .... A61G 7/0524; A61G 7/08; A61G 2203/16; A61G 2203/726
See application file for complete search history.

(56) References Cited

U.S. PATENT DOCUMENTS 6,378,152 B1 4/2002 Washburn et al.
6,396,224 B1 5/2002 Luff et al.
6,560,492 B2 5/2003 Borders
6,584,628 B1 7/2003 Kummer et al.
6,641,521 B2 11/2003 Kolarovic
6,829,796 B2 12/2004 Salvatini et al.
6,877,572 B2 4/2005 Vogel et al.
7,010,369 B2 3/2006 Borders et al.
7,011,172 B2 3/2006 Heimbrock et al.
7,014,000 B2 3/2006 Kummer et al.
7,090,041 B2 8/2006 Vogel et al.
7,154,397 B2 12/2006 Zerhusen et al.
7,195,253 B2 3/2007 Vogel et al.
7,273,115 B2 9/2007 Kummer et al.
7,296,312 B2 11/2007 Menkedick et al.
7,310,839 B2 12/2007 Salvatini et al.
7,506,390 B2 3/2009 Dixon et al.
7,520,006 B2 4/2009 Menkedick et al.
7,761,942 B2 7/2010 Benzo et al.
7,802,332 B2 9/2010 Kummer et al.
7,828,092 B2 11/2010 Vogel et al.
7,834,768 B2 11/2010 Dixon et al.
7,926,131 B2 4/2011 Menkedick et al.
7,953,537 B2 5/2011 Bhai
7,975,335 B2 7/2011 O'Keefe et al.
8,048,005 B2 11/2011 Dixon et al.
8,051,931 B2 11/2011 Vogel et al.
8,056,164 B2 11/2011 Benzo et al.
8,056,165 B2 11/2011 Kummer et al.
8,240,410 B2 8/2012 Heimbrock et al.
8,260,475 B2 9/2012 Receveur
8,260,517 B2 9/2012 Bhai
8,267,206 B2 9/2012 Vogel et al.
8,286,282 B2 10/2012 Kummer et al.
8,334,777 B2 12/2012 Wilson et al.
8,429,778 B2 4/2013 Receveur et al.
8,458,833 B2 6/2013 Hornbach et al.
8,474,074 B2 7/2013 O'Keefe et al.
8,618,918 B2 12/2013 Tallent et al.
8,712,591 B2 4/2014 Receveur
8,756,726 B2 6/2014 Hamberg et al.
8,757,308 B2 6/2014 Bhai et al.
9,213,956 B2 12/2015 Huster et al.
9,253,259 B2 2/2016 Tallent et al.
9,757,293 B2 9/2017 Turner et al.
10,945,902 B2 3/2021 Paul et al.
2014/0291950 A1* 10/2014 Hough ..... A61G 5/127 280/47.4
2015/0005675 A1 1/2015 Riley et al.
2016/0022039 A1* 1/2016 Paul ..... A47C 7/506 297/217.6
2016/0022218 A1 1/2016 Hayes et al.
2016/0302985 A1 10/2016 Tessmer et al.
2018/0369039 A1 12/2018 Bhimavarapu et al.
2019/0142667 A1* 5/2019 Paul ..... A61G 7/012 5/600
2021/0154067 A1 5/2021 Paul et al.

* cited by examiner

FIG. 3

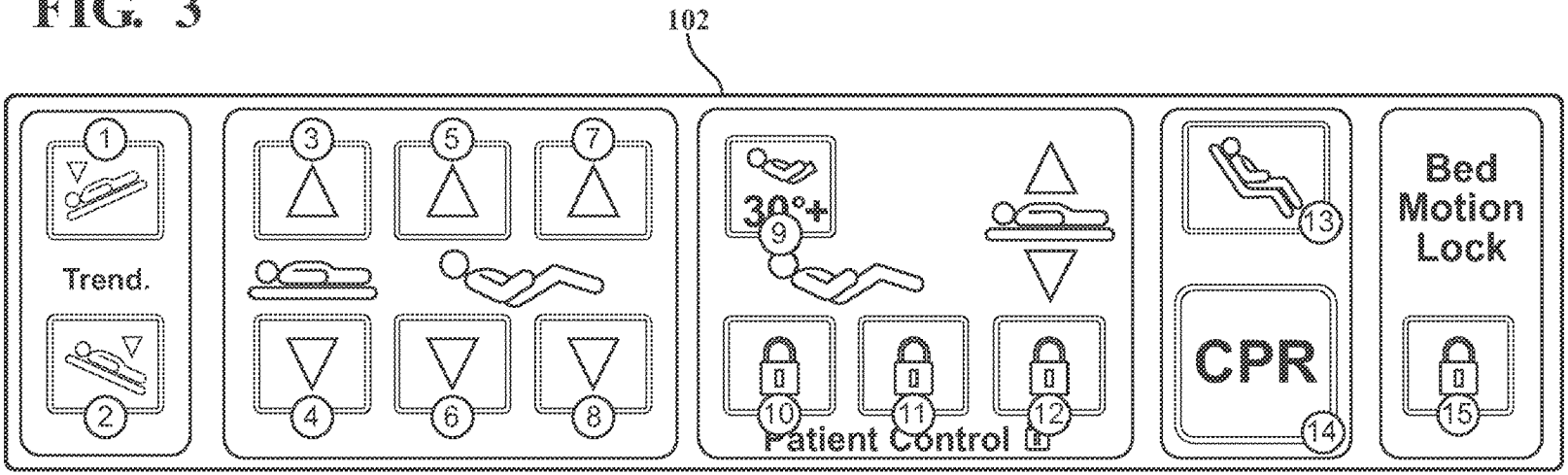

| User Input | Input Signal (202) | State of Manually Adjustable Components (204) | Motion Command Signal (206) | | | |
|---|---|---|---|---|---|---|
| | | | Command 1: Actuators 124, 125 | Command 2: Actuators 121, 122, 123 | Coordinated Motion? | Simultaneous Motion Allowed? |
| 3 | Lift Up | - | LIFT_UP | - | N | Y |
| 4 | Lift Down | Siderails (170) - UP<br>Deployable Wheel (195) - DOWN<br>Foot Extender (182) - IN | LIFT_DN_SR_UP_EXT_IN | - | N | Y |
| 4 | Lift Down | Siderails (170) - UP<br>Deployable Wheel (195) - DOWN<br>Foot Extender (182) - OUT | LIFT_DN_SR_DN_EXT_OUT | - | Y | N |
| 2 | Trend | - | LIFT_TREND | - | Y | N |
| 9 | Fowler30 | - | - | FOWLER_30 | N | N |

| Input Signal (202) | Motion Command Signal (206) | |
|---|---|---|
| | Command 1: Actuators 124, 125 | |
| Lift Up | LIFT_UP | |

| Input Signal (202) | Motion Command Signal (206) |
| --- | --- |
| | Command 2: Actuators 121, 122, 123 |
| Fowler30 | Fowler_30 |

FIG. 5C

| Input Signal (202) | State of Manually Adjustable Components (204) | Motion Command Signal (206) |
|---|---|---|
| Lift Down | Siderails (170) - UP<br>Wheel (195) - DEPLOYED<br>Foot Extender (182) - OUT | Command 1: Actuators 124,125<br>LIFT_DN_SR<br>UP_EXT_OUT |

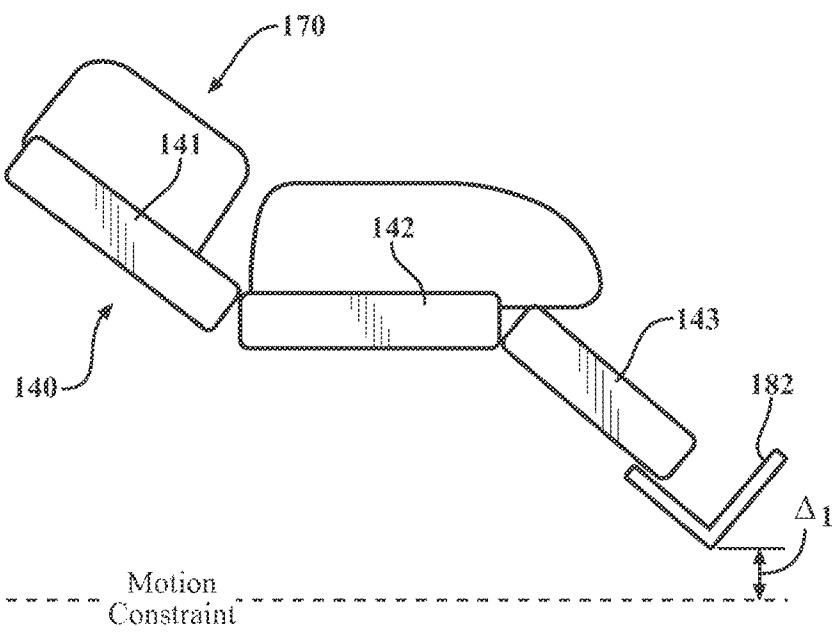

FIG. 5D

| Input Signal (202) | State of Manually Adjustable Components (204) | Motion Command Signal (206) |
|---|---|---|
| Lift Down | Siderails (170) - UP<br>Wheel (195) - DEPLOYED<br>Foot Extender (182) - IN | Command 1: Actuators 124,125<br>LIFT_DN_SR<br>UP_EXT_IN |

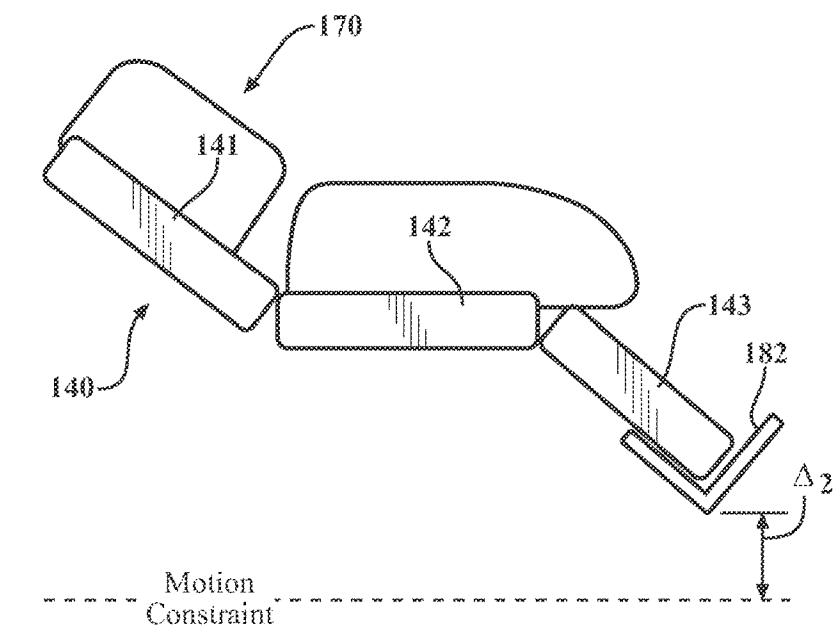

| Input Signal (202) | Motion Command Signal (206) | |
|---|---|---|
| | Command 1: Actuators 124,125 | Coordinated Motion? |
| Trend | LIFT_TREND | Y |

FIG. 6

500

| User Input: Input Signal (202) | 6: Fowler Down | 5: Fowler Up/SR Up | 7: Gatch Up | 8: Gatch Down | 3: Lift Up |
|---|---|---|---|---|---|
| 6: Fowler Down | X | | X | X | X |
| 5: Fowler Up | | X | X | X | |
| 7: Gatch Up | X | X | X | X | X |
| 8: Gatch Down | X | X | X | X | X |
| 3: Lift Up | X | | X | X | X |

| | |
|---|---|
| X | = Allowed Combination of Two Commands at the Same Time |
| | = Not Allowed/Possible Combination of Two Commands at the Same Time |

TECHNIQUES FOR CONTROLLING ACTUATORS OF A PATIENT SUPPORT APPARATUS

CROSS-REFERENCE TO RELATED APPLICATIONS

The subject patent application is a Continuation of U.S. patent application Ser. No. 17/166,126, filed on Feb. 3, 2021, which is a Continuation of U.S. patent application Ser. No. 16/186,857, filed on Nov. 12, 2018 and issued as U.S. Pat. No. 10,945,902 on Mar. 16, 2021, which claims priority to and all the benefits of U.S. Provisional Patent Application No. 62/585,226 filed on Nov. 13, 2017, the disclosures of each of which are hereby incorporated by reference in their entirety.

BACKGROUND

Actuators are commonly used on a patient support apparatus for various purposes. For example, the patient support apparatus may be equipped with a lift assembly that uses actuators to lift a patient resting on a patient support surface to a desired height. Another example is an actuator used to manipulate angular positioning of portions of the patient support surface, such as the fowler, etc.

Control of such actuators according to conventional techniques falls short in many ways. For example, actuators on a patient support apparatus are typically controlled using multiple controllers. In such configurations, the multiple controllers typically require frequent communication between one another. Furthermore, such communication is typically slow as communication between multiple controllers is more tortuous when compared to communication that is confined within a single controller. As such, a patient support apparatus requiring multiple controllers controls the actuators at a slower rate and less efficiently.

Furthermore, because actuator control using multiple controllers requires frequent communication between the controllers, it is difficult to develop the controllers separately or in isolation. This can prove problematic in a situation where a first developer produces a first controller and a second developer produces a second controller. As such, there are opportunities to address at least the aforementioned problems.

BRIEF DESCRIPTION OF THE DRAWINGS

Advantages of the present invention will be readily appreciated as the same becomes better understood by reference to the following detailed description when considered in connection with the accompanying drawings wherein:

FIG. 3 illustrates one example of the user interface of the patient support apparatus with a table including user inputs to the user interface.

FIGS. 5A, 5B, 5C, 5D, and 5E illustrate example motions of the patient support apparatus.

FIG. 6 is a table illustrating example combinations of user inputs to the user interface and combinations of user inputs that may be executed simultaneously.

DETAILED DESCRIPTION

Referring to the Figures, wherein like numerals indicate like or corresponding parts throughout the several views, techniques for controlling actuators of a patient support apparatus are provided.

I. Patient Support Apparatus Overview

Figure 1:
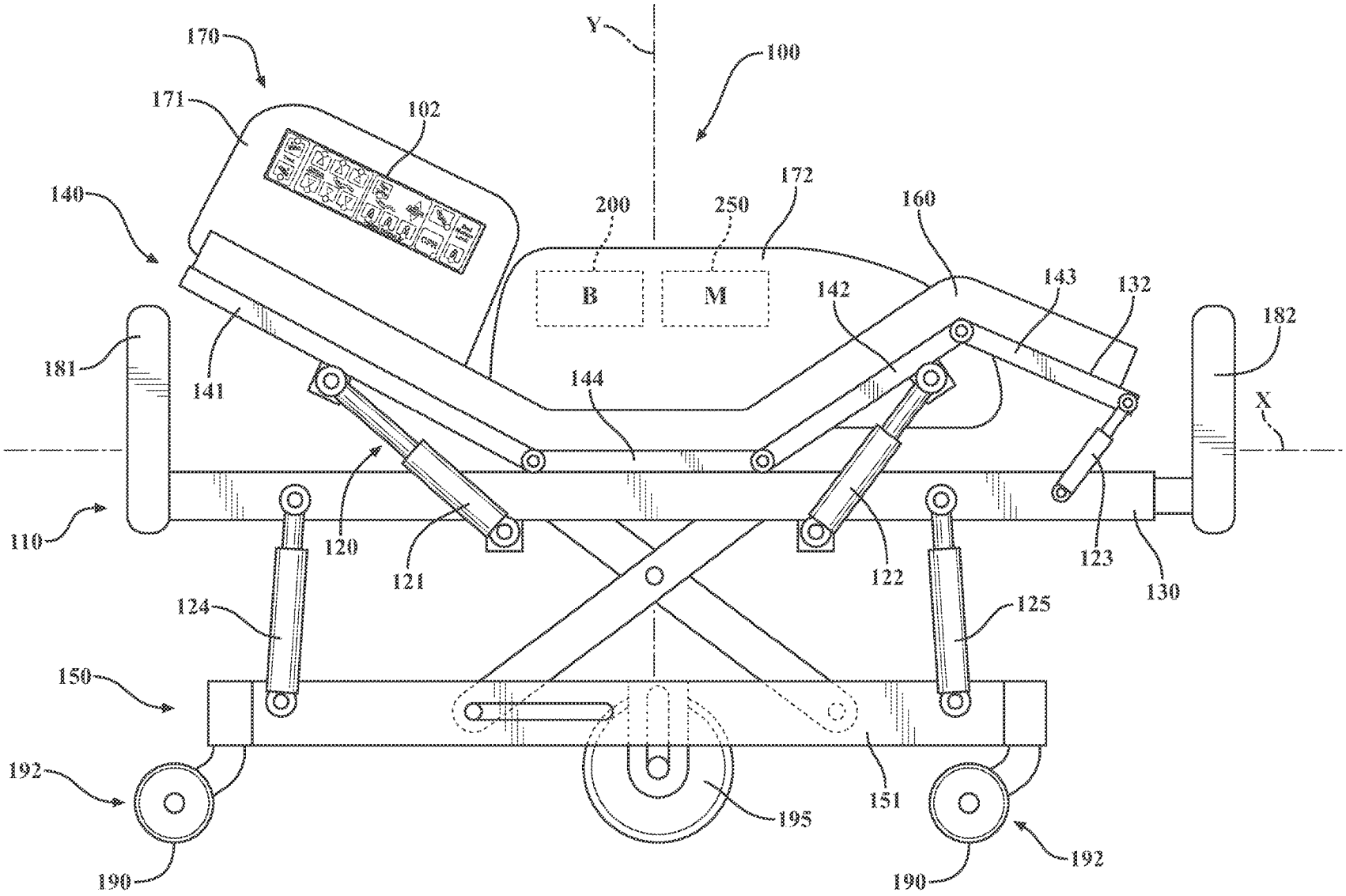
FIG. 1 is a side view, partially in phantom, of a patient support apparatus according to one example.

Referring to FIG. 1, an embodiment of a patient support apparatus 100 is shown for supporting a patient, such as in a health care setting. The patient support apparatus 100 illustrated in FIG. 1 is a bed. In other embodiments, however, the patient support apparatus 100 may include a stretcher, cot, table, wheelchair, or similar apparatus utilized in the care of a patient.

As shown in FIG. 1, the patient support apparatus 100 includes a support structure 110. The support structure 110 provides support for the patient and includes a plurality of components that are moveable. As shown, the support structure 110 includes a base 150 and a support frame 130. The base 150 includes a base frame 151 and the support frame 130 is spaced above the base frame 151. The support frame 130 provides support for the patient and is moveable relative to the base 150. In the embodiment shown in FIG. 1, the support frame 130 may be vertically adjusted, altering the vertical distance between the support frame 130 and the base frame 151.

It is to be appreciated that the construction of the support structure 110 may take on any suitable design, and is not limited to that specifically set forth in FIG. 1. Any embodiments of the support structure 110 discussed herein are not intended to be exhaustive or be construed as limited.

Additionally, the support structure 110 in FIG. 1 includes a patient support deck 140, which is another moveable component. The patient support deck 140 is disposed on the support frame 130 and provides a patient support surface 132 upon which the patient is supported. The patient support deck 140 includes several sections, a back section 141, a thigh section 142, a foot section 143, and a seat section 144. In the embodiment shown in FIG. 1, the back section 141, the thigh section 142, and the foot section 143 are capable of articulating relative to the support frame 130, altering a position of the patient.

It should be noted that the back section 141, the thigh section 142, the foot section 143, and the seat section 144, are named to correspond with a designated placement of a patient on the patient support apparatus 100. Accordingly, the patient support deck 140 has a head end and a foot end, just as the base 150 and the support frame 130 also each have a head end and a foot end.

A mattress 160 may be disposed on the patient support deck 140. The mattress 160 includes a secondary patient support surface upon which the patient is supported. In addition, the mattress may be omitted in certain embodiments, such that the patient rests directly on the patient support surface 132.

Furthermore, the support structure 110 may include side rails 170, which may also be moveable. In FIG. 1, the side rails 170 are coupled to the support frame 130 and are supported by the base 150. A first side rail 171 is positioned at the left head end of the support frame 130. A second side rail 172 is positioned at the left foot end of the support frame 130. A third side rail (not shown) is positioned at the right head end of the support frame 130. A fourth side rail (not shown) is positioned at the right foot end of the support frame 130. If the patient support apparatus 100 is a stretcher or a cot, there may be fewer side rails. The side rails 170 are moveable to a raised position in which they block ingress and egress into and out of the patient support apparatus 100, one or more intermediate positions, and a lowered position in which they are not an obstacle to such ingress and egress. It should be noted that, in some embodiments, the patient support apparatus 100 may not include any side rails.

The support structure 110 may also other moveable components such as a headboard 181 or a foot extender 182. In the embodiment shown in FIG. 1, the headboard 181 and the foot extender 182 are coupled to the support frame 130, with the foot extender 182 being extendable from the support frame 130. In other embodiments, the headboard 181 and foot extender 182 may be coupled to other locations on the patient support apparatus 100, such as the base 150, while remaining moveable. In still other embodiments, the patient support apparatus 100 may not include the headboard 181 and/or the foot extender 182 and the foot extender 182 may not be moveable.

As shown in FIG. 1, the support structure 110 may also include wheels 190, which serve as another moveable component of the support structure 110. The wheels 190 are coupled to the base 150 and facilitate transport over the floor surfaces. The wheels 190 are arranged in each of four quadrants of the base 150 adjacent to corners of the base 150. In the embodiment shown, the wheels 190 are caster wheels able to rotate and swivel relative to the support structure 110 during transport. Each of the wheels 190 forms part of a caster assembly 192. Each caster assembly 192 is mounted to the base 150. It should be understood that various configurations of the caster assemblies 192 are contemplated. In addition, in some embodiments, the wheels 190 are not caster wheels and may be non-steerable, steerable, non-powered, powered, or combinations thereof. Additional wheels are also contemplated. For example, the patient support apparatus 100 may comprise four non-powered, non-steerable wheels, along with one or more powered wheels. In some cases, the patient support apparatus 100 may not include any wheels.

In other embodiments, such as the embodiment shown in FIG. 1, the support structure 110 may also include one or more deployable wheels 195 (powered or non-powered), which are moveable between stowed positions and deployed positions. For example, in FIG. 1, the deployable wheel 195 is coupled to the support frame 130 and arranged substantially in a center of the base 150. In further embodiments, these deployable wheels may be located between caster assemblies 192 and contact the floor surface in the deployed position, causing two of the caster assemblies 192 to be lifted off the floor surface thereby shortening a wheel base of the patient support apparatus 100.

Additionally, caregiver interfaces, such as handles, may be integrated into the headboard 181, the foot extender 182, and/or the side rails 170 to facilitate movement of the patient support apparatus 100 over floor surfaces. In some embodiments, the caregiver interfaces are graspable by a caregiver to manipulate the patient support apparatus 100 for movement. The caregiver interfaces may also be moveable components as they may be optionally deployed or stowed. Furthermore, additional caregiver interfaces may be integrated into other components of the patient support apparatus 100.

The patient support apparatus 100 also includes a plurality of actuators 120 configured to actuate one or more of the moveable components of the support structure 110. Accordingly, the one or more moveable components of the support structure 100 that are moved according to actuation by the actuators 120 are referred to as actuatable components of the support structure 110. In some embodiments, the actuatable components include one or more components of the patient support deck 140 and the support frame 130.

In the embodiment shown in FIG. 1, the plurality of actuators 120 includes actuators 121, 122, 123, 124, and 125, and with each actuator 120 being configured to actuate an actuatable component of the support structure 110. For example, in the embodiment shown in FIG. 1, actuator 121 is configured to actuate the back section 141 of the patient support deck 140 relative to the support frame 130. Actuator 122 and actuator 123 are configured to actuate the thigh section 142, and the foot section 143 of the patient support deck 140, respectively, relative to the support frame 130. Similarly, actuators 124 and 125 are configured to actuate the head end or the foot end of the support frame, relative to the base 150. It will be appreciated that the actuators 120, 121, 122, 123, 124, 125 are depicted generically throughout the drawings (e.g., see FIG. 1), and can be arranged in a number of different ways sufficient to facilitate movement of the actuatable components. By way of non-limiting example, in some embodiments, the patient support apparatus 100 could employ actuators and/or actuatable components arranged or otherwise configured as disclosed in U.S. Patent Application Publication No. 2016/0302985 A1, the disclosure of which is hereby incorporated by reference in its entirety. Other configurations are contemplated.

In this example, the plurality of actuators 120 are shown to actuate the actuatable components along X and Y axes, which are represented by dotted lines in FIG. 1. However, it should be noted that the actuators 120 may be configured to actuate the actuatable components along any of X, Y, and Z axes. Furthermore, the actuators 120 may be configured to actuate the actuatable components individually, sequentially, or simultaneously.

The plurality of actuators 120 may be configured to actuate components of the patient support apparatus 100 other than the previously specified actuatable components of the support structure 110. For example, in one embodiment, an actuator may be configured to actuate the seat section 144 of the patient support deck 140.

II. Configuration of the User Interface, the Behavior Controller, and the Motion Controller As shown in FIG. 1, the patient support apparatus 100 includes a user interface 102 configured to receive a user input to manipulate one or more of the actuatable components. In FIG. 1, the user interface 102 is found on the first side rail 171. However, in other embodiments, the user interface 102 may be located on the headboard 181, the foot extender 182, the second side rail 172, the caregiver interfaces, a portable pendant or computing device, or any other suitable component of the patient support apparatus 100.

The patient support apparatus 100 also includes a behavior controller 200 coupled to the user interface 102 and a motion controller 250 coupled to the behavior controller 200 and the plurality of actuators 120. The behavior controller 200 and the motion controller 250 are together configured to execute the user input received by the user interface 102. In FIG. 1, the behavior controller 200 and the motion controller 250 are found on the second side rail 172. However, in other embodiments, the behavior controller 200 and the motion controller 250 may be located on the headboard 181, the foot extender 182, the second side rail 172, the caregiver interfaces, or any other suitable component of the patient support apparatus 100. Furthermore, the behavior controller 200 and the motion controller 250 may be located on different components of the patient support apparatus 100.

Figure 2:
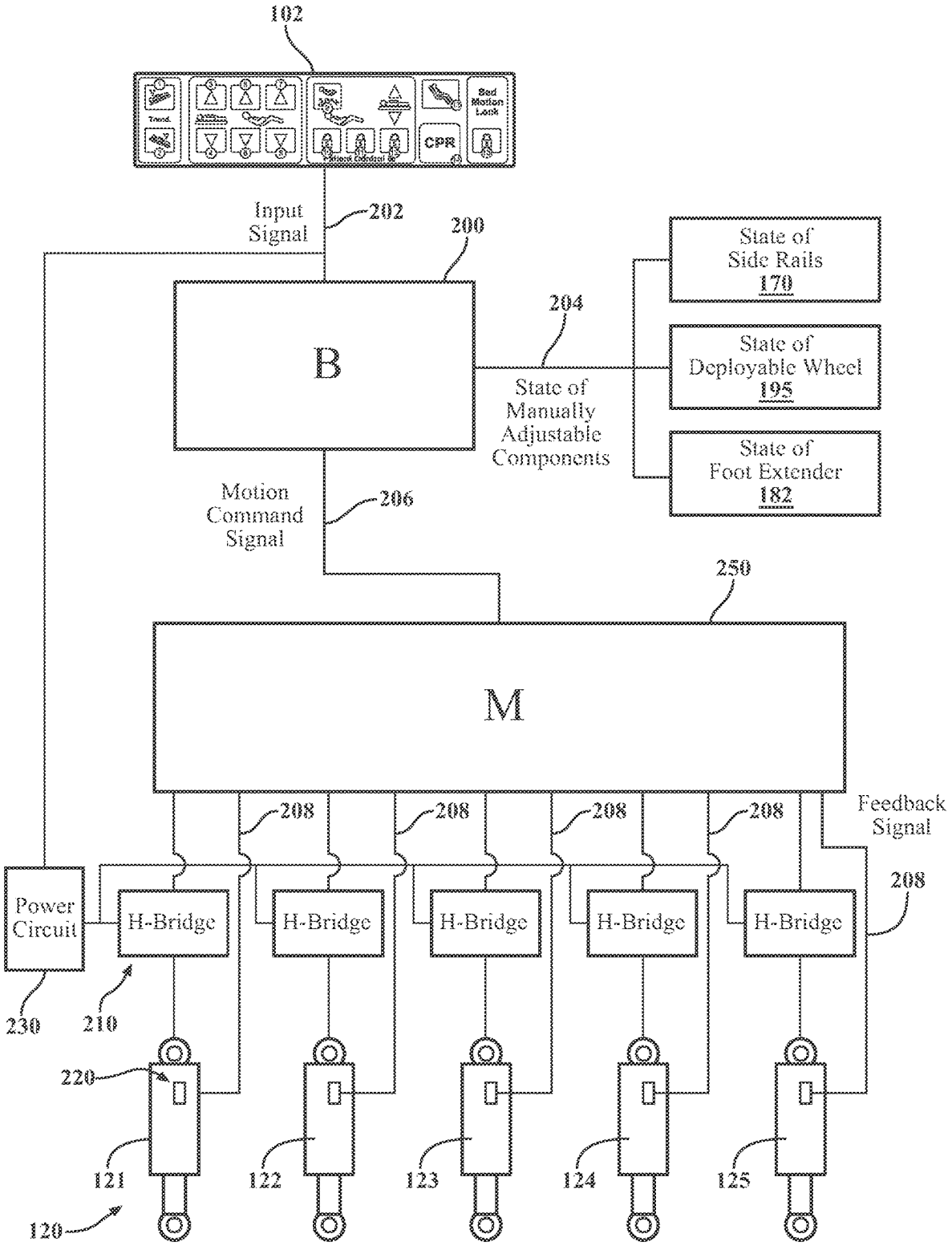
FIG. 2 is a block diagram illustrating one example of a control system for the patient support apparatus, comprising a user interface, a behavior controller, a motion controller, and actuators for the patient support apparatus.

FIG. 2 is a block diagram illustrating an example configuration of the user interface 102, behavior controller 200, and motion controller 250. As previously stated, the behavior controller 200 and the motion controller 250 are together configured to execute the user input received by the user interface 102. In the embodiment of the patient support apparatus shown in FIGS. 1 and 2, the behavior controller 200 and the motion controller 250 serve as separate and distinct devices, allowing the behavior controller 200 and the motion controller 250 to control the actuators 120 quickly and efficiently, and allowing isolated development of the behavior controller 200 and the motion controller 240. This relationship between the behavior controller 200 and motion controller 250 is further explained below.

One example of the user interface 102 is provided in FIG. 3. As shown, the user interface 102 includes a variety of buttons, such that the user interface 102 receives a user input corresponding to a motion of the patient support apparatus 100 when a button is pushed. It should be noted that, in some embodiments, the buttons on the user interface 102 may be arranged in a different order and may appear differently than shown in FIG. 3. In still other embodiments, the user interface 102 may include a touch screen display for receiving the user input, switches for receiving the user input, or any other suitable means of receiving the user input.

In other embodiments, the user interface 102 may include buttons corresponding to motions of the patient support apparatus 100 not shown on the user interface 102 in FIG. 3. For example, the user interface 102 may include buttons corresponding to lowering the back section 141 (referred to as a "fowler" in some embodiments), raising the back section 141, raising the back section 141 by a designated angular amount, lowering the thigh section 142 and/or the foot section 143 (referred to as a "gatch" in some embodiments), raising the thigh section 142 and/or the foot section 143, lifting the support frame 130, lowering the support frame 130, lowering the head end of the support frame 130 and/or raising the foot end of the support frame 130 (a motion referred to as "trend" in some embodiments), lowering the foot end of the support frame 130 and/or raising the head end of the support frame 130 (a motion referred to as "reverse trend" in some embodiments), positioning the patient support apparatus 100 into a chair configuration, flattening the patient support apparatus 100 into a bed configuration, repositioning the patient support apparatus 100 to allow for easy egress, positioning the patient support apparatus 100 in a vascular position, and preparing the patient support apparatus 100 for CPR.

Additionally, FIG. 3 also features a motion matrix 300, which includes several examples of user inputs of the user interface 102. The motion matrix 300 also includes signals received or transmitted by the user interface 102 and the behavior controller 200 in response to the user inputs. It is to be understood that the motion matrix 300 is a table intended to aid in understanding the interrelated operation/function of the user interface 102 and behavior controller 200. The motion matrix 300 shown in FIG. 3, is one example, and is not intended to demonstrate all possible user inputs provided by the user interface 102. The motion matrix 300 may be stored in a non-transitory computer readable medium or memory coupled to the behavior controller 200.

As previously discussed, the user interface 102 receives the user input to manipulate one or more of the actuatable components. Once the user interface 102 receives the user input, the user interface 102 produces an input signal 202 in response to receiving the user input, as shown in FIG. 2.

Referring now to FIG. 3, and specifically, to a first row 301 in the motion matrix 300, a user of the user interface 102 chooses, in one example, to lift the support frame 130 and pushes "Button 3" on the user interface 102. As a result, the user interface 102 receives "Button 3" as the user input and produces the input signal 202, "Lift Up".

Referring back to FIG. 2, the behavior controller 200 receives the input signal 202 from the user interface 102. The behavior controller 200 generates a motion command signal 206 based on the input signal and transmits the motion command signal 206.

In FIG. 2, the motion controller 250 receives the motion command signal 206 from the behavior controller 200. Once the motion controller 250 receives the motion command signal 206, the motion controller 250 controls one or more actuators of the plurality of actuators 120 to actuate one or more of the actuatable components based on the motion command signal 206.

Referring to the first row 301 of the motion matrix 300, the user interface 102 produces the input signal 202, "Lift Up" and the behavior controller 200 generates the motion command signal 206 based on the "Lift Up" input signal 202 and transmits the motion command signal 206 to the motion controller 250. The motion command signal 206 transmitted to the motion controller 250 specifies a software command, "LIFT_UP", for controlling actuator 124 and actuator 125. Accordingly, the motion controller 250 proceeds to carry out the specified software command, "LIFT_UP", to raise the head end and the foot end of the support frame, relative to the base 150, using actuators 124, 125.

Additionally, the motion controller 250 is also configured to receive feedback signals 208 from the actuators 120 associated with one or more actuatable components, as shown in FIG. 2. The feedback signals 208 are provided solely to the motion controller 250. In other words, the feedback signals 208 do not return to the behavior controller 200 thereby enabling fast execution of commands using a shorter closed-loop control defined between the actuators 120 and the motion controller 250, rather than a longer closed-loop control returning back to the behavior controller 200.

These feedback signals 208 include signals or information used for controlling the actuators 120. In some embodiments, the feedback signals 208 may include an initial state of the actuatable components, an ending state of the actuatable components, a current state of the actuatable components, and/or an operational characteristics of the actuatable components. In such embodiments, a state of the actuatable components may correspond to, but is not limited to, a position (height, length, angle, etc.) and/or an orientation of the actuatable components. An operational characteristic of the actuatable component may correspond to, but is not limited to, a speed, velocity, or acceleration of the actuatable component. Other operational characteristics may include electrical current drawn by the actuator 120, or the like. As such, the motion controller 250 controls one or more of the actuators 120 by understanding what is desired from the motion command signal 206 and by understanding a state or operation of the actuators 120 from the feedback signals 208.

In the embodiment shown in FIG. 2, the motion controller 250 controls the actuators 120 by supplying a voltage across H-bridges 210. Additionally, the feedback signals 208 are provided to the motion controller 250 via Hall effect sensors 220 located on the actuators 120. Therefore, to continue the above example where the behavior controller 200 generates the motion command signal 206 based on the "Lift Up" input signal 202, the motion controller 250 receives the motion command signal 206 and controls the actuator 124 and actuator 125 to lift the support frame 130. The Hall effects sensors 220 provide feedback signals 208 to the motion controller 250, enabling the motion controller 250 to control actuator 124 and actuator 125. It should be appreciated that the actuators 120 may be controlled using techniques other than supplying voltage across H-bridges 210. Furthermore, any type of technique for producing or measuring feedback signals 208 may be utilized other than techniques utilizing Hall effect sensors 220.

Figure 4:
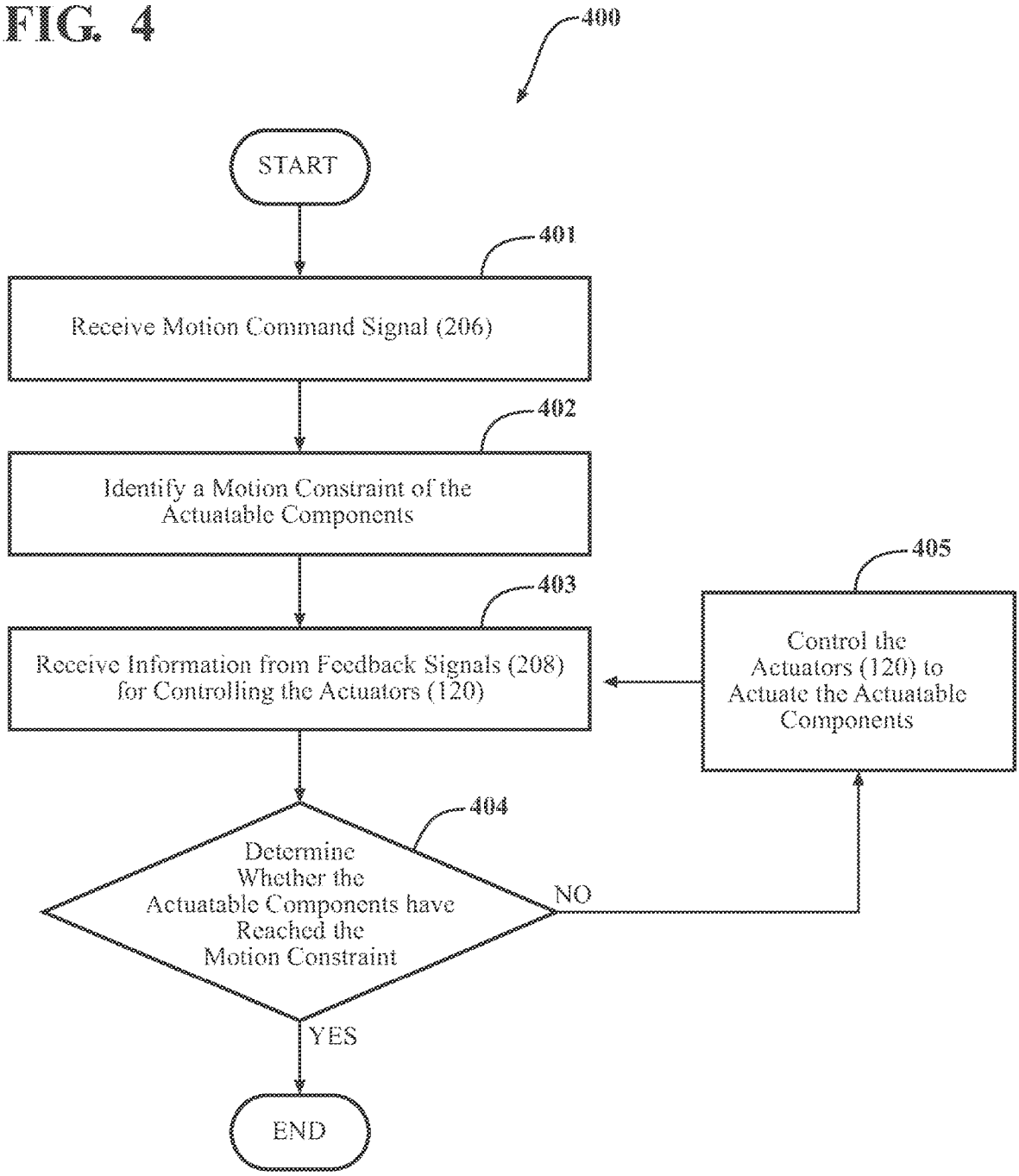
FIG. 4 is a flowchart of a method of operating the motion controller of the patient support apparatus.

Referring to FIG. 4, one example of a method 400 of operating the motion controller 250 is further explained using the flowchart shown. As previously stated, and shown in block 401 of the flowchart, the motion controller 250 receives the motion command signal 206 from the behavior controller 200. Then, the motion controller 250 optionally identifies a motion constraint of the one or more actuatable components in block 402. The motion constraint is described in detail below. In block 403, the motion controller 250 receives or derives information from the feedback signals 208 for controlling the actuators 120 to actuate the actuatable components. In block 404, the motion controller 250 optionally determines whether the actuatable components have reached the motion constraint. If so, the method 400 ends and the motion controller 250 ceases control of the actuators 120. Otherwise, the method proceeds to block 405, where the motion controller 250 continues controlling the actuators 120 to actuate the actuatable components. As will be appreciated from the examples herein, reaching the motion constraint may not necessarily result in the method 400 ending, but rather, the motion constraint may be considered during control of actuator 120 movement, without the actuator 120 necessarily reaching the motion constraint.

Figure 5A:
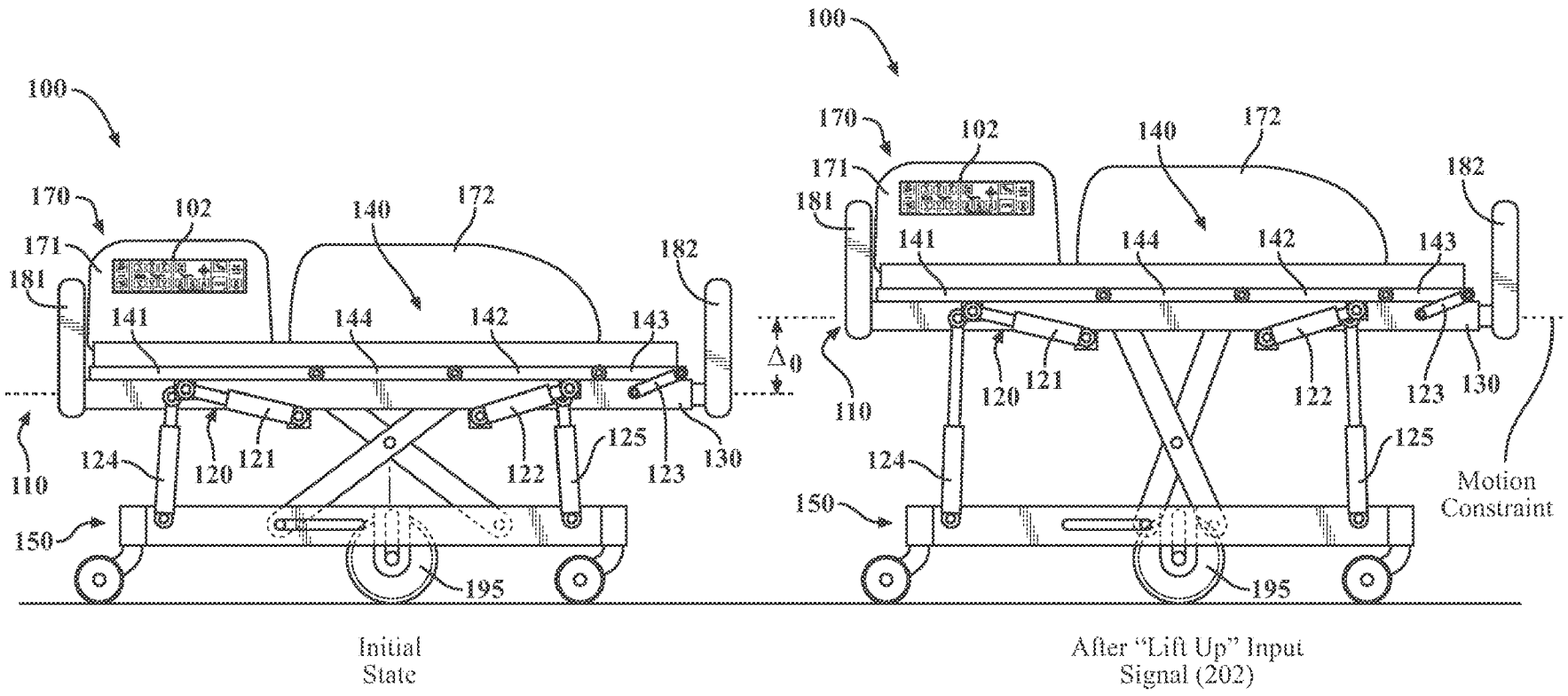

In some embodiments, the motion constraint may include a range of motion limitation of the actuatable component and/or a constraint to avoid collision or interference with another component of the patient support apparatus 100 or an object, such as a ceiling, a floor, a wall, or a person located near the patient support apparatus 100. For example, in FIG. 5A, two instances of the patient support apparatus 100 are shown, the patient support apparatus 100 in its initial state and the patient support apparatus 100 after the user pushes "Button 3" on the user interface, producing the "Lift Up" input signal 202. As shown, the motion controller 250 controls actuator 124 and actuator 125 to actuate the support frame 130 until the support frame 130 reaches the motion constraint, represented by a dotted line. In this example, the motion constraint may represent a max height, or range of motion of the support frame 130. The motion constraint may also represent a height to avoid collision or interference with an object overhead.

Figure 5B:
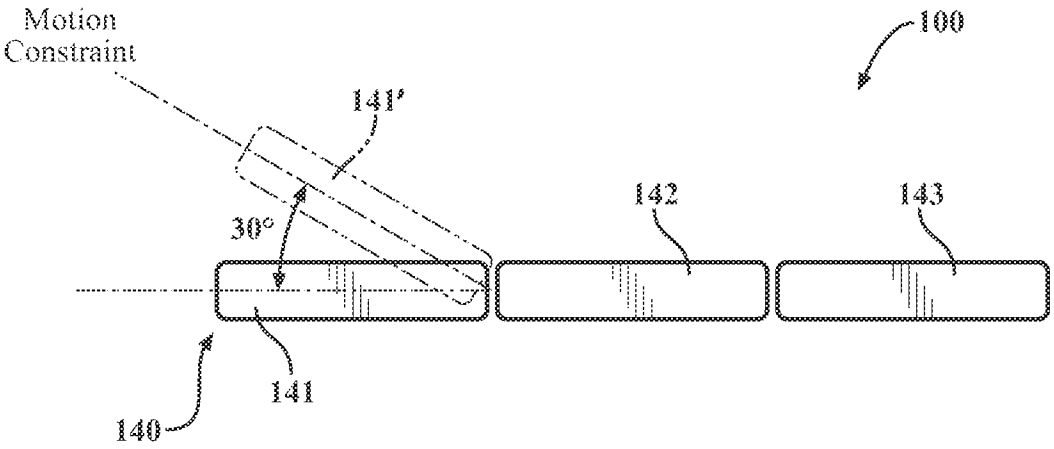

In another embodiment, the motion constraint may be based on the motion command signal 206. For example, in FIG. 5B, the behavior controller 200 receives a "Fowler30" input signal 202 and generates the motion command signal 206, specifying a command, "FOWLER_30", for controlling actuator 121, actuator 122, and actuator 123. The "Fowler30" input signal 202 corresponds to the user of the user interface 102 pressing "Button 9" to incline the back section 141, known as the "fowler", by 30 degrees. Accordingly, the motion controller 250 identifies the motion constraint of the back section 141 to be angled 30 degrees above the initial position of the back section 141, as shown using a simplified representation of the patient support apparatus 100 in FIG. 5B. In this way, the motion controller 250 identifies the motion constraint of an actuatable component based on the motion command signal 206.

As previously mentioned, in the embodiment of the patient support apparatus 100 shown in FIGS. 1 and 2, the behavior controller 200 and the motion controller 250 serve as distinct entities. To explain, the behavior controller 200 generates the motion command signal 206 based on the input signal 202 produced by the user interface 102 and the motion controller 250 controls the actuators 120 based on the motion command signal 206. To control the actuators 120 based on the motion command signal 206, the motion controller 250 uses the feedback signals 208 provided solely to the motion controller 250. In this way, the motion controller 250 exercises direct control of the actuators 120 to the exclusion of the behavior controller 200. As a result, the behavior controller 200 and the motion controller 250 collectively are able to control the actuators 120 quickly and efficiently and are able to be developed in isolation.

Referring back to the block diagram in FIG. 2, the patient support apparatus 100 also includes a power circuit 230. The power circuit 230 is coupled to the H-bridges 210, providing the H-bridges 210 with a voltage for operation. Furthermore, the power circuit 230 is coupled to the user interface 102, such that the power circuit 230 provides the voltage to the H-bridges 210 when the user interface 102 produces the input signal 202. In this way, the power circuit 230 ensures that a user of the user interface 102 continually provides a user input in order for the motion controller 250 to control the actuators 120. In other words, control of the actuators 120 occurs when the user of the user interface 102 is holding down a button on the user interface 102 and ceases when the user of the user interface 102 is no longer holding down a button on the user interface 102. Additionally, while the embodiment shown in FIG. 2 includes the power circuit 230, it is to be appreciated that the patient support apparatus 100 may include any other suitable means of ensuring that the user of the user interface 102 continually provides a user input when controlling the actuators 120.

As previously discussed, the motion controller 250 may cease control of the actuators 120 when the motion controller 250 determines that the adjustable components have reached the identified motion constraint. An inclusion of the power circuit 230 allows the motion controller 250 to cease control of the actuators 120 prior to the actuatable components reaching the motion constraint. Similarly, the motion controller 250 will cease control of the actuators 120 if the adjustable components reach the motion constraint, even if the power circuit 230 is still providing voltage to the H-bridges 210.

III. Manually Adjustable Components Embodiment

In some embodiments of the patient support apparatus 100, the moveable components of the support structure 110 may comprise one or more manually adjustable components that are not actuated by the actuators 120. For example, in FIG. 1, the patient support apparatus 100 includes side rails 170, the foot extender 182, and the deployable wheel 195, all of which are manually adjustable components, e.g., manually adjusted by physical force exerted by a user.

In further embodiments of the patient support apparatus 100, the behavior controller 200 may be further configured to identify a state of one or more manually adjustable components and to generate the motion command signal 206 based on, or otherwise considering, the state of the manually adjustable components. Referring to the example of FIG. 2, the behavior controller 200 identifies the state of the manually adjustable side rails 170, the manually adjustable foot extender 182, and the manually deployable wheel 195. It is to be appreciated that, in other embodiments, the behavior controller 200 may identify a state of manually adjustable components not listed above. Any suitable sensing techniques may be utilized to detect the state of the manually adjustable components, and the degree of adjustment for each component.

Referring to a second row 302 of the motion matrix 300 in FIG. 3, the user of the user interface 102 selects "Button 4" to lower the support frame 130. Accordingly, the user interface 102 produces the input signal 202, "Lift Down". For the input signal 202, "Lift Down", the behavior controller 200 identifies the state of the manually adjustable components 204. As shown in the second row 302, the behavior controller 200 identifies the state of the side rails 170 as "UP", the state of the deployable wheel 195 as "DEPLOYED", and the state of the foot extender 182 as "IN".

In this example, the behavior controller 200 generates the motion command signal 206 specifying a software command, "LIFT_DN_SR_UP_EXT_IN", and transmits the motion command signal 206 to the motion controller 250. In response, the motion controller 250 controls actuator 124 and actuator 125 to lower the support frame 130 of the patient support apparatus 100 having side rails 170 "UP" and foot extender "IN".

In contrast, in a third row 303 of the motion matrix 300, the behavior controller 200 identifies the state of the side rails 170 as "DOWN", the state of the deployable wheel 195 as "DEPLOYED", and the state of the foot extender as "OUT". In this example, the behavior controller 200 instead generates the motion command signal 206 specifying a software command, "LIFT_DN_SR_DN_EXT_OUT", and transmits the motion command signal 206 to the motion controller 250. Here, the motion controller 250 controls actuator 124 and actuator 125 to lower the support frame 130 with side rails 170 "DOWN" and foot extender "OUT".

It is to be appreciated that, the behavior controller 200 may generate the motion command signal 206 based on the state of the manually adjustable components 204 for some input signals 202 and without the state of the manually adjustable components 204 for other input signals 202. For example, in the embodiment shown in FIG. 3, the behavior controller 200 generates the motion command signal 206 based on the state of the manually adjustable components 204 for the input signal 202, "Lift Down", but the behavior controller 200 generates the motion command signal 206 without the state of the manually adjustable components 204 for the input signal 202, "Lift Up".

FIGS. 5C and 5D illustrate, using simplified representations of the patient support apparatus 100, how the state of the manually adjustable components 204 affect the motion controller 250 and corresponding control of the actuators 120. In FIGS. 5C and 5D, the behavior controller 200 receives an input signal 202, "Lift Down". In FIG. 5C, the behavior controller 200 identifies the state of the side rails 170 as "UP", the state of the deployable wheel 195 as "DEPLOYED", and the state of the foot extender 182 as "OUT". In contrast, the behavior controller 200 in FIG. 5D identifies the state of the side rails 170 as "UP", the deployable wheel 195 as "DEPLOYED", and the foot extender 182 as "IN". Furthermore, both FIGS. 5C and 5D illustrate the motion constraint identified by the motion controller 250, as well a distance the patient support apparatus 100 may be lowered, labeled $\Delta_1$ and $\Delta_2$, respectively. Here, the motion constraint relates to interference with floor surface, which can be identified using predetermined data about dimensions of the components of the patient support apparatus 100, such as the support sections 141, 142, 143, and the relative states of relevant components. As shown, the patient support apparatus 100 in FIG. 5D may be lowered a greater distance, $\Delta_2$, than the patient support apparatus 100 in FIG. 5C because the foot extender 182 of the patient support apparatus 100 in FIG. 5D is not extended while the foot extender 182 of the patient support apparatus 100 in FIG. 5C is extended. The motion controller 250 controls the patient support apparatus 100 according to these two examples differently, i.e., by lowering the patient support apparatus 100 in FIG. 5C a lesser distance than the patient support apparatus 100 in FIG. 5D to avoid collision with the floor surface. Other examples of illustrating how the state of the manually adjustable components 204 affect the motion controller 250 and corresponding control of the actuators 120 may be appreciated from the various embodiments described herein.

IV. Coordinated and Simultaneous Motion Embodiments

The motion controller 250 may be configured to control one or more of the actuators 120 to actuate multiple actuatable components simultaneously based on the motion command signal 206 and the feedback signals 208. The motion controller 250 may control the actuators 120 to actuate multiple actuatable components using "Coordinated Motion."

To control the actuators 120 to actuate multiple actuatable components using "Coordinated Motion", the motion controller 250 determines a current position of the multiple actuatable components. The motion controller 250 then controls multiple actuators 120 such that multiple actuatable component reach a commanded position. Such motion may be coordinated to enable the actuatable components to reach the respective commanded position at the same time. In other examples, motion may be coordinated to enable the actuatable components to start movement at the same time. In yet another example, motion may be coordinated to enable the actuatable components to move sequentially, such that a first component moves towards the commanded position, and another component is moved towards the commanded position after a predetermined time or event. For example, the event may be that the first component has reached the commanded position, a halfway point on the way to the commanded position etc. In any of these examples, the motion controller 250 may speed up, or slow down, actuation provided by any one or more actuators 120 to coordinate motion. Furthermore, in any of these examples, the motion controller 250 may take into account the motion constraint for each of the multiple actuatable components when determining how to coordinate motion.

The motion command signal 206 generated by the behavior controller 200 designates whether the motion controller 250 may control the actuators 120 using "Coordinated Motion" for an input signal 202. For example, referring to a fourth row 304 in the motion matrix 300 of FIG. 3, the behavior controller 200 receives an input signal 202, "Trend", corresponding to the user of the user interface pressing "Button 2" to raise the head end of the support frame 130 and lower the foot end of the support frame 130. As shown in the motion matrix 300, the motion command signal 206 designates that, for the input signal 202, "Trend", the motion controller 250 controls the actuators 120 to actuate the multiple actuatable components using "Coordinated Motion". Thus, coordinated motion is generally triggered for a single input signal 202 that implicates many different actuatable components. Coordinated motion may also be appropriate for actuatable components that are mechanically related or constrained relative to one another.

Once the motion controller 250 receives the motion command signal 206 and the "Coordinated Motion" designation, the motion controller 250 calculates the current position and, optionally, the motion constraint for each actuatable component and controls the actuators 120 accordingly.

Figure 5E:
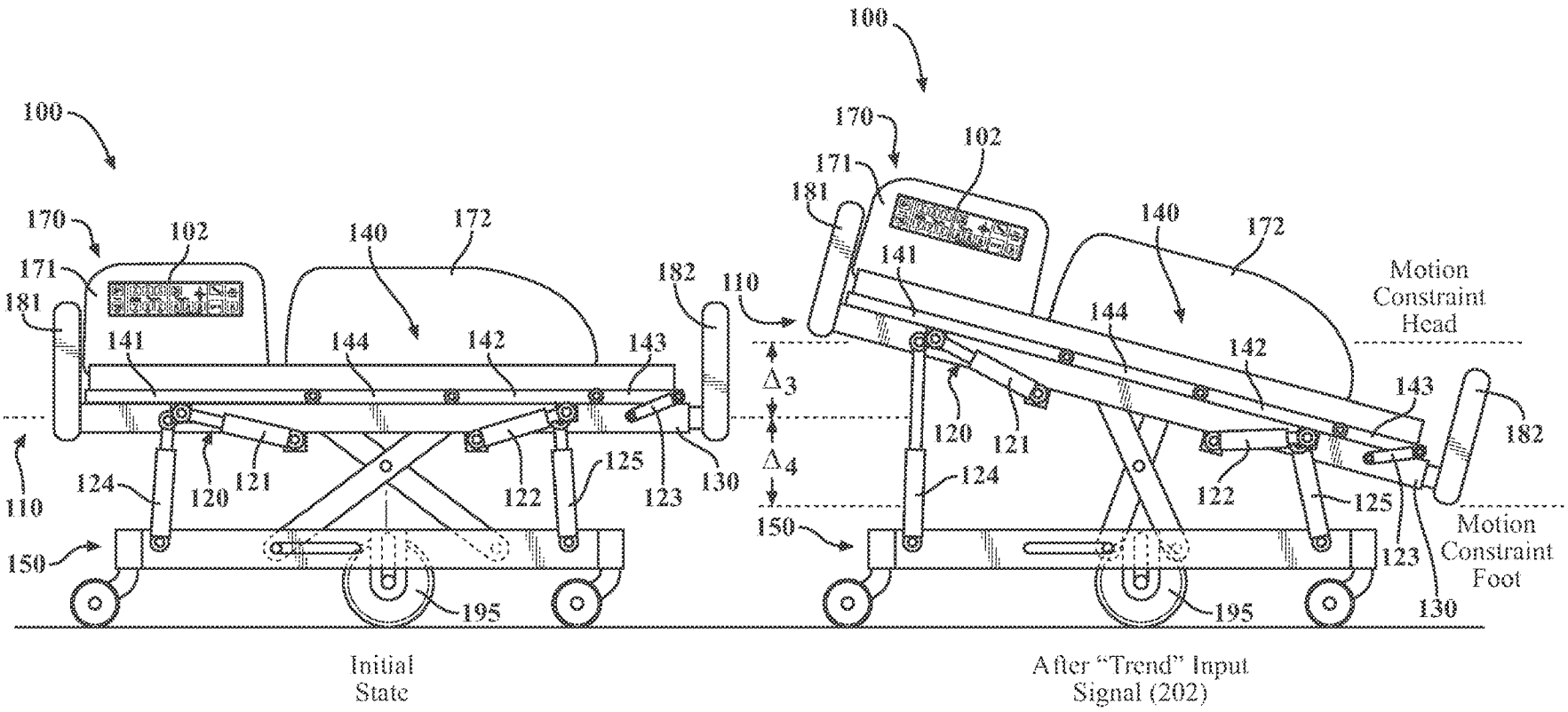

FIG. 5E illustrates one example showing how the motion controller 250 uses "Coordinated Motion" to actuate multiple actuatable components. As shown, FIG. 5E demonstrates two states of the patient support apparatus 100, i.e., the patient support apparatus 100 in an initial state and the patient support apparatus 100 after the user pushes "Button 2" on the user interface, producing the "Trend" input signal 202. In FIG. 5E, the motion controller 250 calculates that actuator 124 moves the head end of the support frame 130 a distance A3 to reach a motion constraint of the head of the support frame 130, labeled "Motion Constraint Head". Additionally, the motion controller 250 calculates that actuator 125 moves the foot end of the support frame 130 a distance of A4 to reach a motion constraint for the foot end of the support frame 130, labeled "Motion Constraint Foot". Accordingly, in this example, the motion controller controls actuator 124 and actuator 125 using "Coordinated Motion", ensuring that the head end of the support frame 130 reaches "Motion Constraint Head" and the foot end of the support frame 130 reaches "Motion Constraint Foot". Such coordinated motion in this example may ensure these components reach their commanded position at the same time.

In some instances, the motion controller 250 controls the actuators 120 to simultaneously execute two user inputs to the user interface 102. In order for the motion controller 250 to control the actuators 120 as such, the user interface 102 first receives two user inputs from the user and produces two input signals 202. Once the behavior controller 200 receives the two input signals, the behavior controller 200 generates the motion command signal 206 for each input signal. Here, the motion command signal 206 includes a "Simultaneous Motion" designation, which indicates whether the motion controller 250 may control the actuators 120 to simultaneously execute the input signal 202 considering the presence of the second input signal 202. For example, referring to the motion matrix 300 in FIG. 3, the input signal 202, "Lift Up", may be executed simultaneously with another input signal 202, whereas the input signal 202, "Trend", may not be executed simultaneously with another input signal 202.

Once the motion controller 250 receives the motion command signal 206 and the "Simultaneous Motion" designation for each input signal 202, the motion controller 250 determines whether it is possible to execute a particular combination of input signals 202. For reference, the "Simultaneous Motion" designation designates whether an input signal 202 may be executed with another input signal 202, whereas the motion controller 250 determines whether a specific combination of input signals 202, each of which are designated for "Simultaneous Motion", may be executed simultaneously.

Referring to FIG. 6, a simultaneous motion table 500 is shown, where boxes marked with an "X" represent a combination of input signals 202 that may be executed simultaneously and empty boxes represent a combination of input signals 202 that may not be executed simultaneously. For example, the motion controller 250 may control the actuators 120 to execute input signals 202, "Fowler Down" and "Lift Up" simultaneously. However, the motion controller 250 may not control the actuators 120 to execute input signals 202, "Fowler Up" and "Lift Up" simultaneously. It is to be understood that the simultaneous motion table 500 is an example table intended to aid in understanding "Simultaneous Motion". The simultaneous motion table 500 exemplifies a possible embodiment should not be construed as exhaustive or limiting.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention claimed is:

1. A patient support apparatus comprising:

a support structure including a base and a plurality of components that are movable, the plurality of components including a support frame;

a plurality of actuators configured to actuate one or more of the components;

a user interface configured to receive a user input to move the support frame and to produce an input signal in response to receiving the user input;

a behavior controller coupled to the user interface and being configured to:

receive the input signal from the user interface, generate a motion command signal based on the input signal, and transmit the motion command signal; and a motion controller separate from and coupled to the behavior controller and to the plurality of actuators and being configured to:

receive the motion command signal from the behavior controller, receive feedback signals from one or more of the plurality of actuators, wherein the feedback signals are provided solely to the motion controller and are not provided to the behavior controller, identify a motion constraint of the one or more actuatable components, wherein the motion constraint comprises a constraint to avoid interference with another component, and control one or more of the plurality of actuators to actuate one or more of the actuatable components based on the motion constraint, the motion command signal, and the feedback signals to move the support frame relative to the base.

2. The patient support apparatus of claim 1, wherein the actuatable components further comprise a patient support deck arranged for movement relative to the support frame.

3. The patient support apparatus of claim 1, wherein the feedback signals comprise one or more of an initial state of the actuatable components, an ending state of the actuatable components, a current state of the actuatable components, and an operational characteristic of the actuatable components.

4. The patient support apparatus of claim 1, wherein the motion constraint further comprises a range of motion limitation of the one or more actuatable components.

5. The patient support apparatus of claim 1, wherein the motion constraint further comprises a constraint to avoid collision with an object.

6. The patient support apparatus of claim 1, wherein the motion constraint is based on the motion command signal.

7. The patient support apparatus of claim 1, wherein the components further comprise one or more manually adjustable components that are not actuated by the actuators.

8. The patient support apparatus of claim 7, wherein the one or more manually adjustable components comprises one or more of a side rail, a deployable wheel, and a bed extender.

9. The patient support apparatus of claim 7, wherein the behavior controller is further configured to identify a state of the one or more manually adjustable components and to generate the motion command signal based on the state of the one or more manually adjustable components.

10. The patient support apparatus of claim 1, wherein the motion controller is further configured to actuate multiple actuatable components simultaneously based on the motion constraint, the motion command signal, and the feedback signals.

11. A patient support apparatus comprising:

a support structure including a base and a plurality of components that are movable, the plurality of components including a patient support deck;

a plurality of actuators configured to actuate one or more of the components;

a user interface configured to receive a user input to move the patient support deck and to produce an input signal in response to receiving the user input;

a behavior controller coupled to the user interface and being configured to:

receive the input signal from the user interface, generate a motion command signal based on the input signal, and transmit the motion command signal; and a motion controller separate from and coupled to the behavior controller and to the plurality of actuators and being configured to:

receive the motion command signal from the behavior controller, receive feedback signals from one or more of the plurality of actuators, wherein the feedback signals are provided solely to the motion controller and are not provided to the behavior controller, identify a motion constraint of the one or more actuatable components, wherein the motion constraint comprises a constraint to avoid interference with another component, and control one or more of the plurality of actuators to actuate one or more of the actuatable components based on the motion constraint, the motion command signal, and the feedback signals to move the patient support deck relative to the base.

12. The patient support apparatus of claim 11, wherein the motion controller is further configured to actuate multiple actuatable components simultaneously based on the motion constraint, the motion command signal, and the feedback signals.

13. The patient support apparatus of claim 11, wherein the feedback signals comprise one or more of an initial state of the actuatable components, an ending state of the actuatable components, a current state of the actuatable components, and an operational characteristic of the actuatable components.

14. The patient support apparatus of claim 11, wherein the motion constraint further comprises a range of motion limitation of the one or more actuatable components.

15. The patient support apparatus of claim 11, wherein the motion constraint further comprises a constraint to avoid collision with an object.

16. The patient support apparatus of claim 11, wherein the motion constraint is based on the motion command signal.

17. The patient support apparatus of claim 11, wherein the components further comprise one or more manually adjustable components that are not actuated by the actuators.

18. The patient support apparatus of claim 17, wherein the one or more manually adjustable components comprises one or more of a side rail, a deployable wheel, and a bed extender.

19. The patient support apparatus of claim 17, wherein the behavior controller is further configured to identify a state of the one or more manually adjustable components and to generate the motion command signal based on the state of the one or more manually adjustable components.

20. The patient support apparatus of claim 11, wherein the actuatable components further comprise a support frame arranged for movement relative to the base, with the patient support deck operatively attached to the support frame.

* * * * *